US007182622B2

(12) United States Patent
Chang

(10) Patent No.: US 7,182,622 B2
(45) Date of Patent: Feb. 27, 2007

(54) ELECTRICAL CONNECTOR ASSEMBLY

(75) Inventor: Che-Chia Chang, Taipei Hsien (TW)

(73) Assignee: Comax Technology Inc, Taipei Hsien (TW)

( * ) Notice: Subject to any disclaimer, the term of this patent is extended or adjusted under 35 U.S.C. 154(b) by 0 days.

(21) Appl. No.: 11/315,167

(22) Filed: Dec. 23, 2005

(65) Prior Publication Data

US 2006/0199418 A1 Sep. 7, 2006

(30) Foreign Application Priority Data

Mar. 4, 2005 (TW) ..... 94203416 U

(51) Int. Cl.
*H01R 13/627* (2006.01)

(52) U.S. Cl. ..... 439/352; 439/358

(58) Field of Classification Search ..... 439/352, 439/358

See application file for complete search history.

(56) References Cited

U.S. PATENT DOCUMENTS 5,755,587 A * 5/1998 Sakai et al. ..... 439/352
6,312,277 B1 * 11/2001 Holub ..... 439/352

* cited by examiner

*Primary Examiner*—Truc Nguyen
(74) *Attorney, Agent, or Firm*—Troxell Law Office, PLLC

(57) ABSTRACT

An electrical connector assembly includes two electrical connectors locking to each other to form electrical connection. One of the electrical connectors provides a holding element having a press section and at least a latch protrusion with a contact baffle wall. The other is a mating electrical connector provides an locking groove to buckle with the latch protrusion and a lateral side of the locking groove and the contact baffle wall. Hence, the contact baffle wall will contact one lateral side of the locking groove steadily without the moment of force from the flexibility of the slit rib for increasing endurance of the operations of inserting and detaching with the lock of a mating electrical connector.

15 Claims, 7 Drawing Sheets

ELECTRICAL CONNECTOR ASSEMBLY

FIELD OF THE INVENTION

The present invention relates to an electrical connector assembly and particularly to an electrical connector assembly, which is applied to a cable connector having a latch unit locked to a mating electrical connector.

BACKGROUND OF THE INVENTION

Generally, an electrical connector for being joined to a cable provides an latch unit at the inserted end thereof to lock a mating electrical connector for preventing to coming off and interrupting signal transmission.

The conventional connector, as shown in FIG. 1, includes an insulation body A having a plurality of conductive terminals C distributed therein, a flexible holding element B and a mating connector D. The conductive terminals C connect the cable through the rear end of the insulation body A. The insulation body A has an inserted opening A1 at the front end thereof, providing the mating connector D with transmission interface inserted into the inserted opening A1. A lateral edge of the inserted opening A1 provides two opposite clamping seats A2 for locating the holding element B. The holding element B includes a base plate B1 and a bend section B2 being bent from a lateral side of the base plate B1 the bend section B2 is parallel and opposite to the base plate B1. The bend section B2 forms a press section B3 at the end thereof and the press section B3 extends a press rib B4 corresponding to the clamping seats A2. Each of clamping seats A2 have a groove A3 forming a limit press space with the press rib B4 therein. A slit ribB5 is manufacture with splitting between the bend section B2 and the press part B3 corresponding to the locking groove D1 of the mating electrical connector D. Flexibility of the holding element B allows the slit ribB5 locking with the mating electrical connector D.

However, when the preceding conventional electrical connector is joined to the paring electrical connector D by means of the holding element B as shown in FIG. 1—1, only the slit rib B5 locked the locking groove D1 of the mating electrical connector D cause by a transverse displacement gap resulted relatively from pressing the flexibility of the slit rib B5 in groove. Thus increasing the moment of force and decreasing endurance against the operations of inserting and detaching. In this way, life span of the electrical connector is shortened relatively.

SUMMARY OF THE INVENTION

An object of the present invention is to provide an electrical connector assembly including a holding element, which is fixed an insulation body of an electrical connector for increasing endurance of the operations of inserting and detaching with the lock of a mating electrical connector.

In order to achieve the preceding objects, an electrical connector assembly according to the present invention includes two electrical connectors locking each other, and forming an electrical connection. One of the electrical connectors provides a holding element having a press section and at least a latch protrusion with a contact baffle wall. The other one is a mating electrical connector providing a locking groove for buckling the contact baffle of the latch protrusion at a lateral side thereof forming flat contact tightly. Hence, the contact baffle wall will contact one lateral side of the locking groove steadily without the moment of force from the flexibility of the slit rib.

BRIEF DESCRIPTION OF THE DRAWINGS

The present invention can be more fully understood by reference to the following description and accompanying drawings, in which:

FIGS. 1—1 shows a sectional view of the conventional electrical connector assembly;

DETAILED DESCRIPTION OF THE INVENTION

Figure 1:
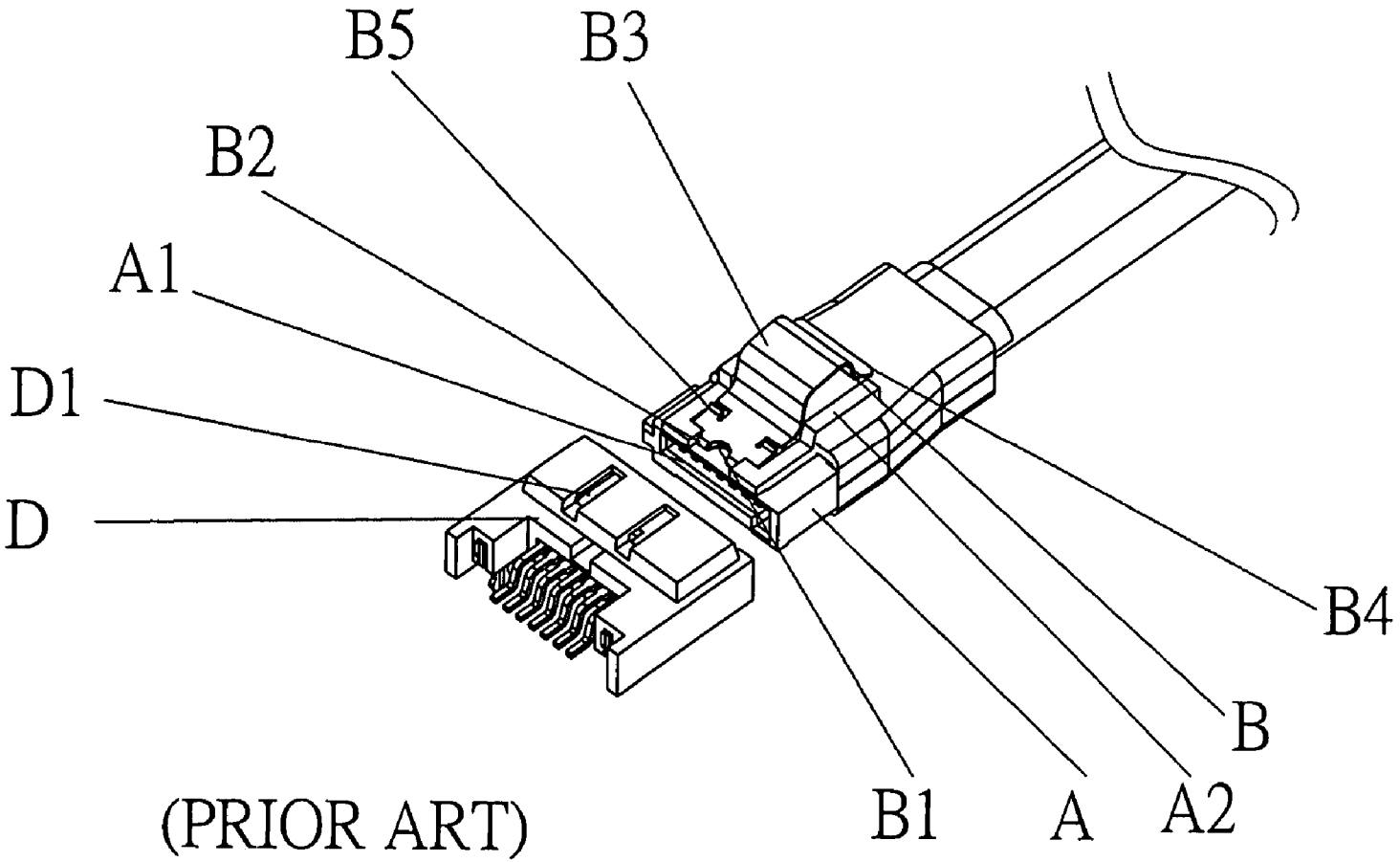
(PRIOR ART) FIG. 1
FIG. 1 shows a perspective view of the conventional electrical connector assembly.
Figure 1:
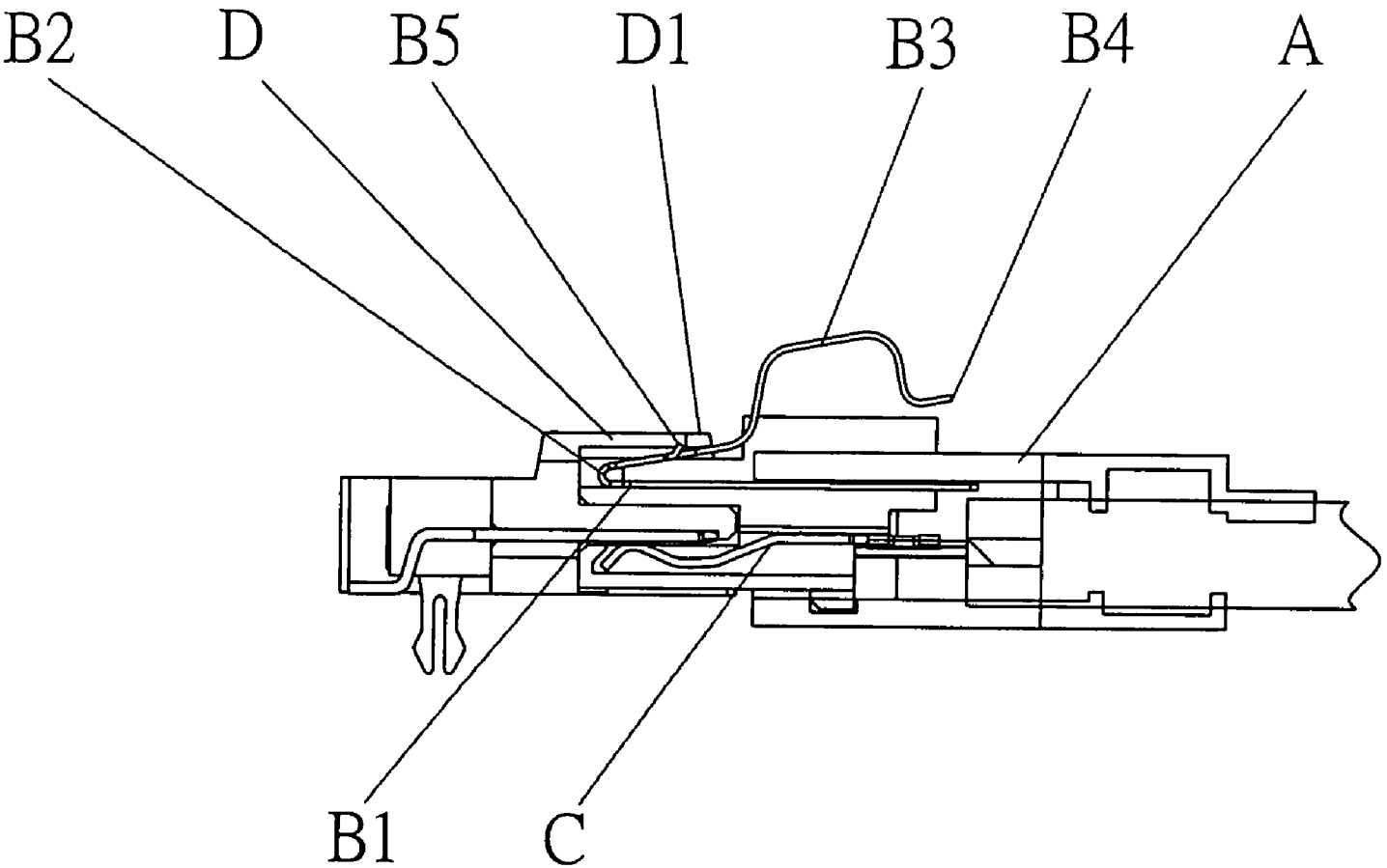
(PRIOR ART) FIG. 1-1
Figure 2:
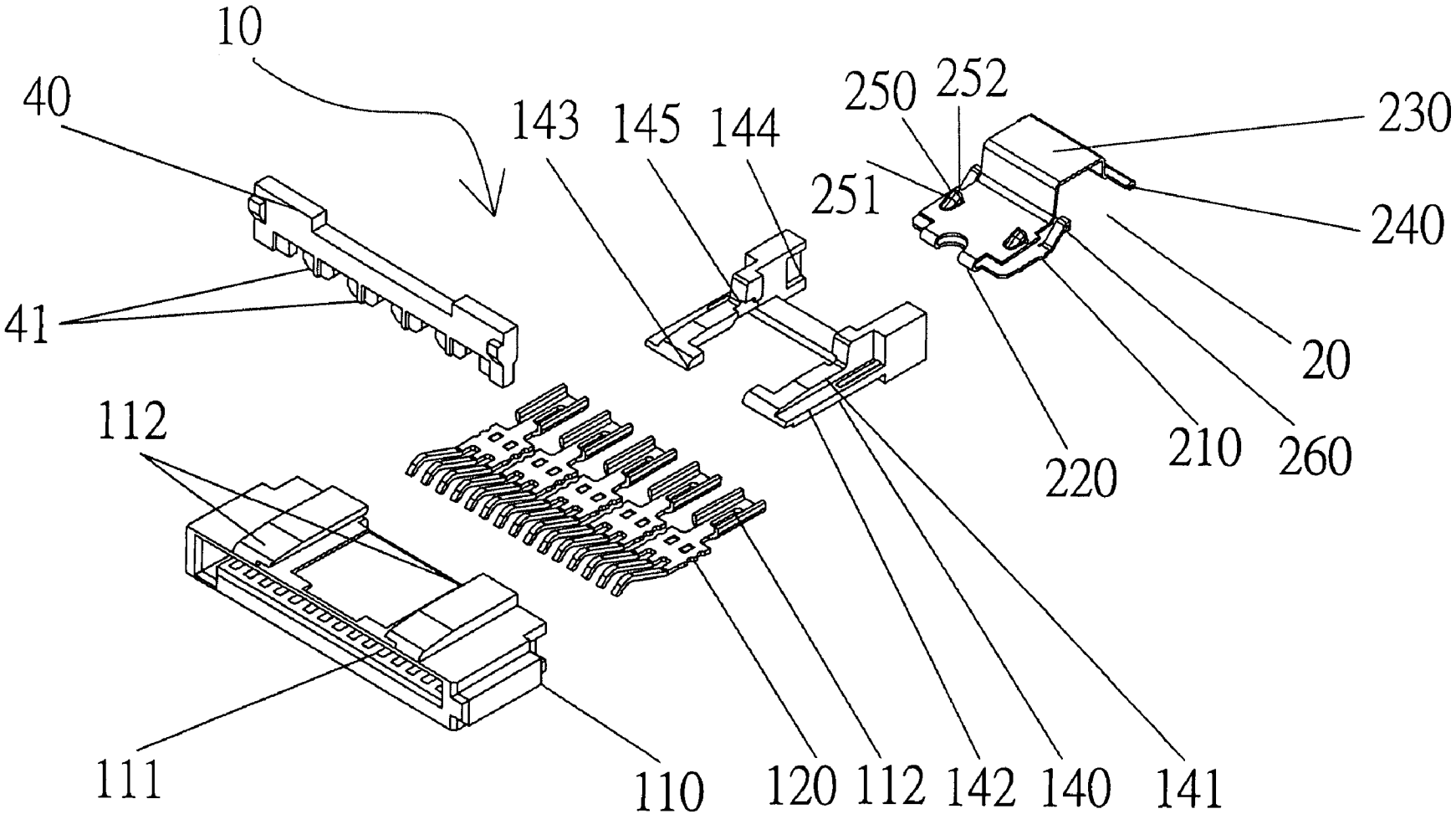
FIG. 2 shows an exploded perspective view of the first preferred embodiment of an electrical connector assembly according to the present invention.

Referring to FIG. 2, an exploded perspective view of the first preferred embodiment of an electrical connector assembly according to the present invention is illustrated. The first embodiment of an electrical connector assembly according to the present invention provides an electrical connector 10 with a holding element 20 for locking with an opposite mating connector 30 steadily and preventing to coming off and interrupting signal transmission.

The electrical connector 10 includes an insulation body 110, a holding element 20 with a flexible material, a plurality of conductive terminal 120 and a locating element 140. The conductive terminals 120 are received in the insulation body 110 and the front end of the insulation body 110 forms an inserted opening 111 for being inserted by the mating connector 30 having transmission interface. A clamping seat 112 is disposed at two lateral sides of the inserted opening 110 respectively and the locating element 140 provides two opposite guiding arms 141 corresponding to the two clamping seats 112. Each of the guiding arms 141 has an engaging part 142 and each clamping seat has a guiding groove 113 to engage with the engaging part 142 respectively such that the locating element 140 is capable of locating the holding element 20 at the insulation body 110. The locating element 140 can be integrally made with the insulation body 110 but it is difficult to develop mold tool relatively. The holding element 20 includes a base plate 210 and a bend section 220 being bent from a lateral side of the base plate 210 is parallel and opposite to the base plate. Each of the guiding arms 141 have an engaging rib 143. Two engaging ribs 143 are extended inward from each guiding arm respectively corresponding to the base plate 210 at the position next to the bend section 220 for blocking up thereat. The rear end of the bend section 220 has a press section 230, which extends a holding rib 240 corresponding to the locating element 140, and the locating element 140 has a first fitting groove 144 therein for the holding rib 240 forming a limit pressing space therein. A latch protrusion 250 is disposed between the bend section 220 and the press section 230 corresponding to a locking groove 330 of the mating connector 30.

The mating connector 30 includes an insulation body 310 with mating terminals being distributed therein as shown in FIG. 2 and an inserted opening 320 for being inserted with the insulation body 110 of the electrical connector 10. The mating connector 30 has a locking groove 330 corresponding to latch protrusion 250 at a lateral side thereof. The insulation body 310 provides a plurality of mating terminals 340 to electrically contact with the conductive terminal 120 of the electrical connector 10. The latch protrusion 250 of the holding element 20 has a guiding area 251 with a contact baffle wall 252 corresponding to the insert end and the contact baffle wall 252 is riveted to the insulation body 110 via the latch protrusion 250.

Figure 3:
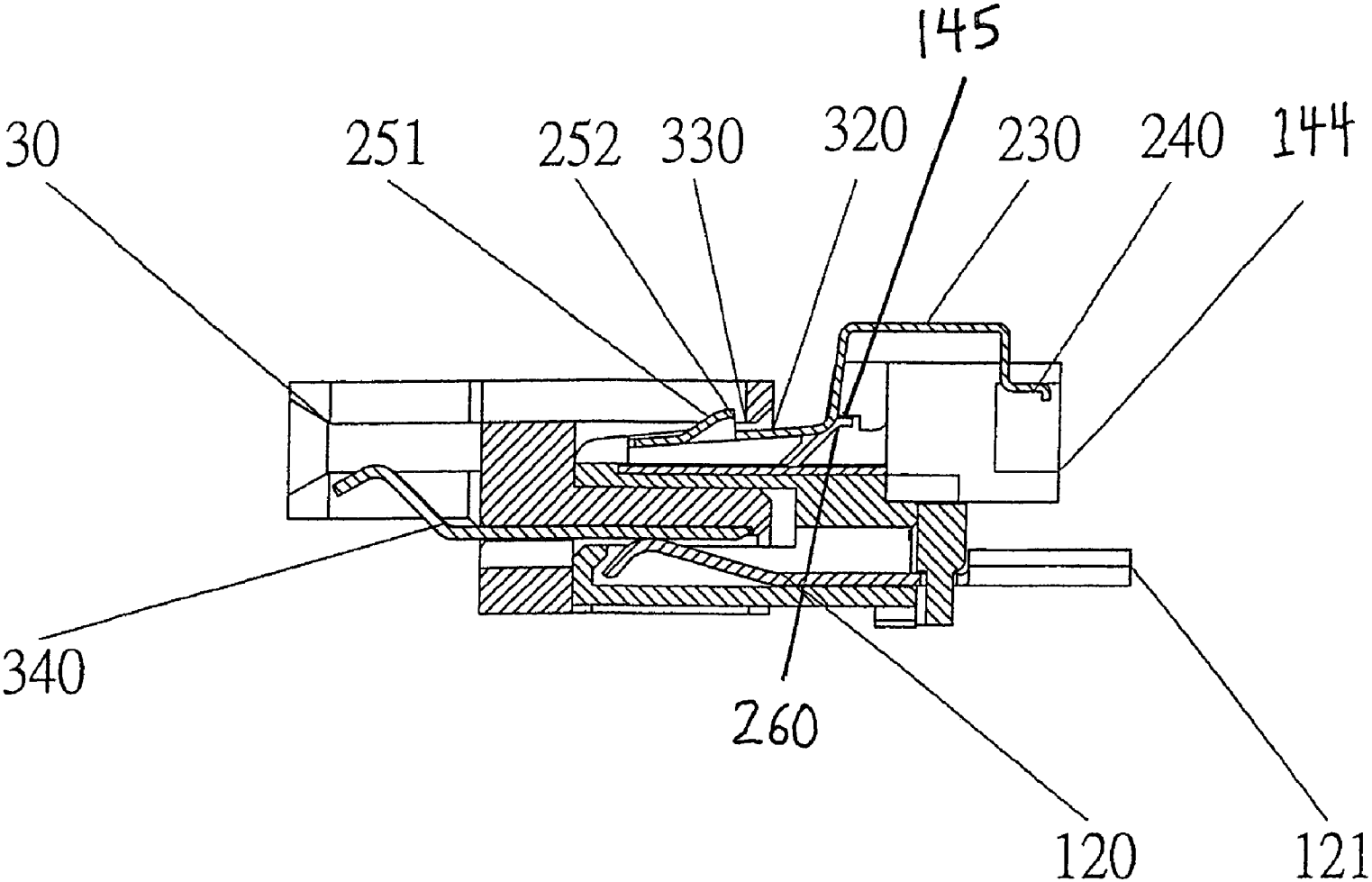
FIG. 3 shows a sectional view of the first preferred embodiment of an electrical connector assembly according to the present invention.

Referring to FIG. 3 with reference to FIG. 2 again, when the connector assembly of the present invention is in use and the electrical connector 10 is inserted to the mating connector 30, the locking groove 330 of the mating connector 30 engages the contact baffle wall 252 of the holding element 20 smoothly via the guiding area 251. Thus, the electrical connector 10 keeps locking with mating connector 30 steadily without moving relatively caused by the moment of force from the flexibility of the slit rib for increasing endurance of the operations of inserting and detaching therein.

Referring to FIG. 2 again, the base plate 210 of the holding element 20 extends an inverted hook 260 toward the bend section 220 symmetrically to be received in a space between the base plate 210 and the bend section 220. The locating element 140 of the electrical connector 10 has a second fitting groove 145 corresponding to the inverted hook 260. Thus, the end 261 of the inverted hook 260 can be located the holding element 20 steadily between the insulation body 110 and the locating element 140 as shown in FIG. 3 for preventing the holding element 20 to come off the insulation body 110.

Furthermore, the electrical connector 10 further includes a blocker 40 disposed under the locating element 140 to engage with 110 and the blocker 40 have a plurality of partitions 41 separate to the conductive terminals 120 for blocking glue member permeated therein during the process of gluing.

Figure 4:
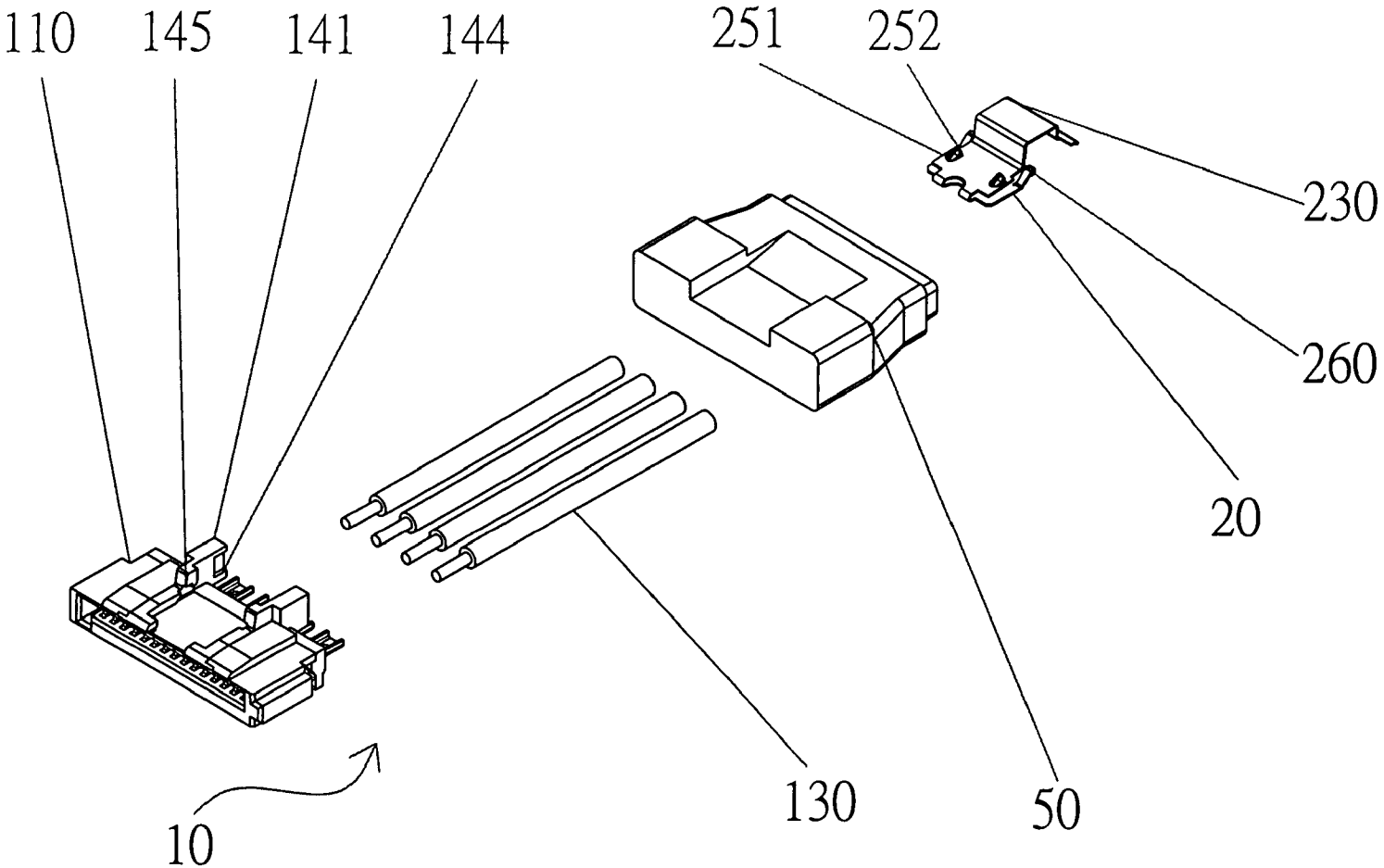
FIG. 4 shows a partly exploded perspective view of the second preferred embodiment of an electrical connector assembly according to the present invention.
Figure 5:
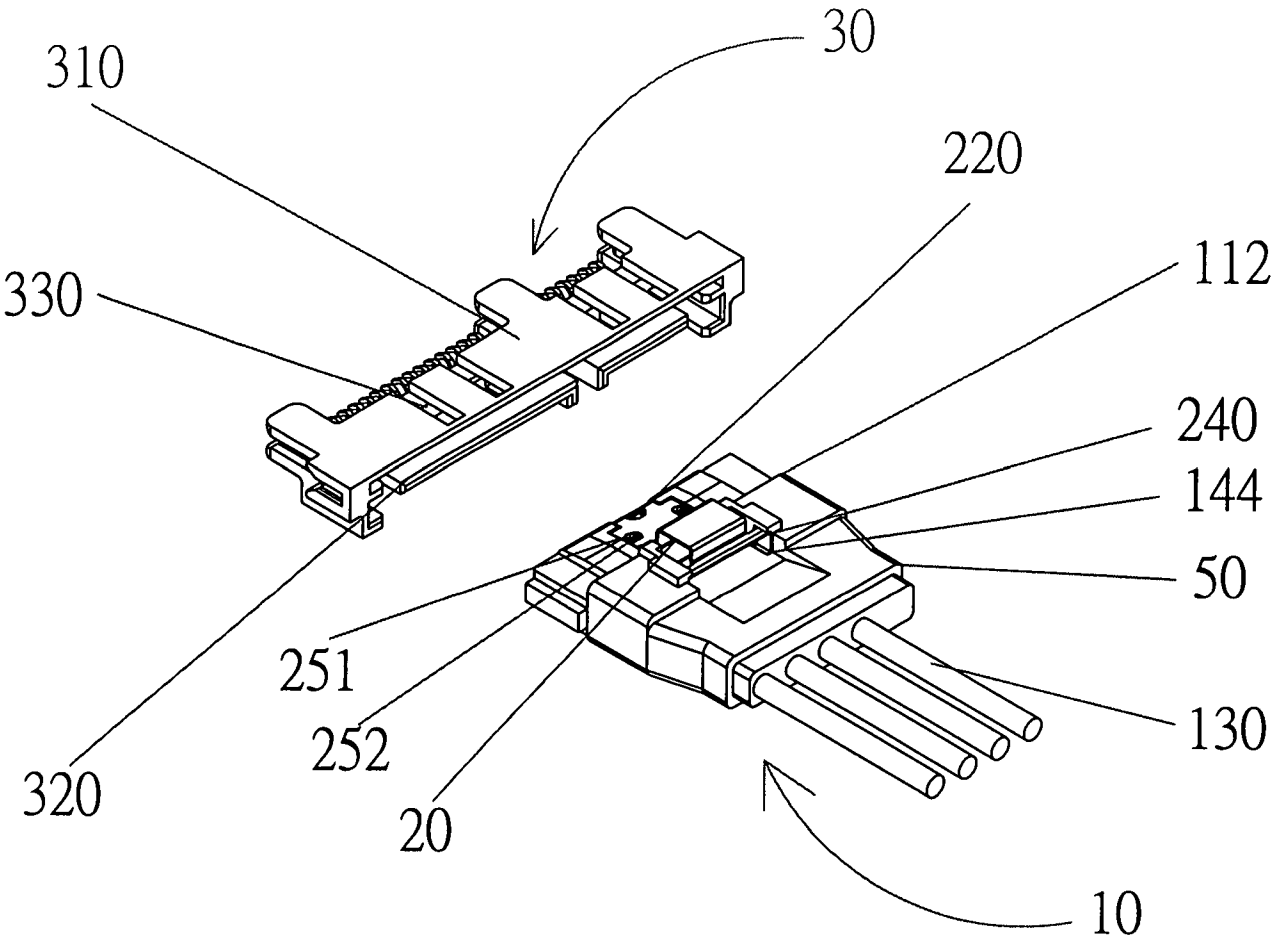
FIG. 5 shows a perspective view of the second preferred embodiment of an electrical connector assembly according to the present invention.

Referring to FIGS. 4 and 5, another embodiment of an electrical connector assembly according to the present invention includes an electrical connector 10 with a holding element 20 for locking a opposite mating electrical connector 30. The electrical connector 10 further includes an insulation body 110 distributed with conductive terminals therein, a flexible holding element 20, a plurality of conductive terminals 120, a cable 130 and a locating element 140. The conductive terminals 120 provide a supportable section 121 at the rear end of the insulation body 110 respectively. The supportable part 121 is available for each of the conductive terminals 120 fixedly connected to a cable 130 and the intersection of insulation body 110 and the cable 130 has a soft housing 50 as shown in FIG. 4 for absorbing bending force of the cable 130.

Figure 6:
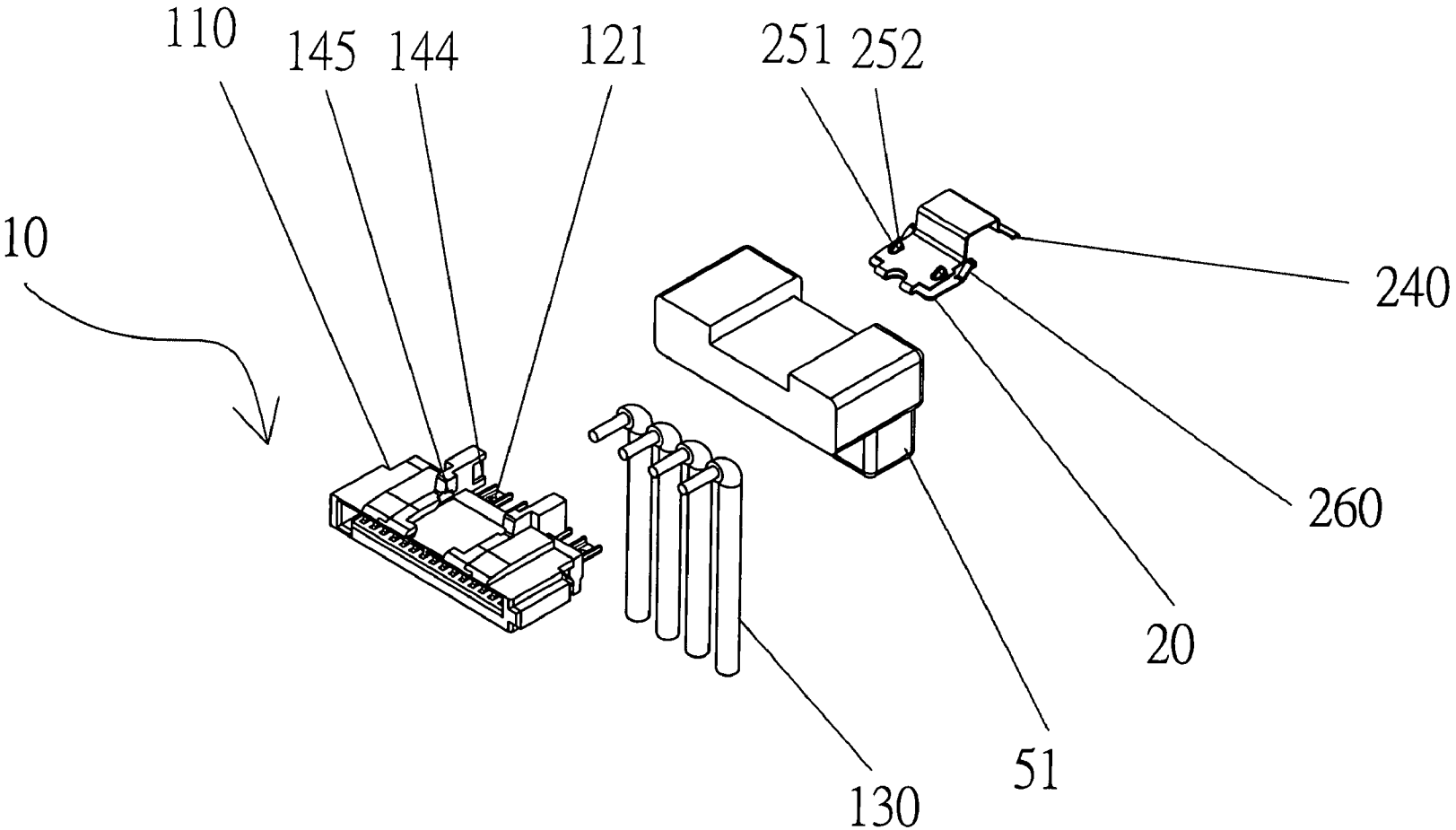
FIG. 6 shows a partly exploded perspective view of the third preferred embodiment of an electrical connector assembly according to the present invention.

Referring to FIG. 6, a further embodiment of an electrical connector according to the present invention is illustrated. The present embodiment provides a soft housing 50 at the intersection of the insulation body 110 and the cable 130 and the soft housing 50 has a guiding opening 51 at the vertical surface thereof to allow the cable 130 passing through the guide opening 41 after being bent. In this way, the bending force of the cable 130 is absorbed by the soft housing 50 such that the user is able to be guided outward via the rear end of the insulation body 110 either horizontally or vertically.

While the invention has been described with reference to the preferred embodiments thereof, it is to be understood that modifications or variations may be easily made without departing from the spirit of this invention, which is defined by the appended claims.

What is claimed is:

1. An electrical connector, which locks with a locking groove of a mating electrical connector, comprising:

an insulation body, receiving a plurality of conductive terminals and electrically connecting with a cable of the conductive terminals; and a holding element, being located in the insulation body, further comprising a press section and at least a latch protrusion with a contact baffle wall engaging the locking groove, the insulation body further comprising clamping seats on an upper surface of the insulation body;

a locating element having two opposite guiding arms configured to engage the corresponding clamping seats;

wherein the front end of the insulation body forms an inserted opening for being inserted with the mating electrical connector, which has a transmission interface;

wherein the base plate has an inverted hook corresponding to the bend section to be received in a second fitting groove on an inner surface of the guiding arms to limit the space the inverted hook travels in the second fitting groove and a first groove is formed in a rear inner surface of the locating element for receiving a holding rib;

wherein and the press section extends the holding rib to limit the space the holding rib travels in the first fitting groove.

2. The electrical connector as defined in claim 1, wherein the holding element is secured to the electrical connector via the latch protrusion.

3. The electrical connector as defined in claim 1, wherein the holding element further comprises:

a base plate; and a bent section, being bent from a lateral side of the base plate is parallel and opposite to the base plate and providing a press section at the rear end thereof.

4. The electrical connector as defined in claim 1, wherein the conductive terminals at the rear end of the insulation body have a supportable part respectively being fixedly connected to the cable electrically.

5. The electrical connector as defined in claim 1, further comprises a blocker to engage with the insulation body and the blocker provides a plurality of partitions to separate the conductive terminals.

6. The electrical connector as defined in claim 1, further comprises a soft housing disposed at an intersection of the insulation body and the cable.

7. The electrical connector as defined in claim 6, wherein the soft housing provides a guiding opening at the vertical surface thereof.

8. An electrical connector, which engages with an engaging groove of a mating electrical connector, comprising:

an insulation body, receiving a plurality of conductive terminals and electrically connecting with a cable of the conductive terminals, the insulation body further comprising clamping seats on an upper surface of the insulation body;

a locating element, being fixedly engaged with a lateral side of the insulation body, the locating element having two opposite guiding arms configured to engage the corresponding clamping seats; and a holding element, being fixedly engaged with the locating element, further comprising a press section and at least a latch protrusion with a contact baffle wall engaging the locking groove, wherein the front end of the insulation body forms an inserted opening for being inserted with the mating electrical connector, which has a transmission interface;

wherein the base plate has an inverted hook corresponding to the bend section to be received in a second fitting groove on an inner surface of the guiding arms to limit the space the inverted hook travels in the second fitting groove and a first groove is formed in a rear inner surface of the locating element for receiving a holding rib;

wherein and the press section extends the holding rib to limit the space the holding rib travels in the first fitting groove.

9. The electrical connector as defined in claim 8, wherein the holding element is secured to the electrical connector via the latch protrusion.

10. The electrical connector as defined in claim 8, wherein the holding element further comprises:

a base plate; and a bent section, being bent from a lateral side of the base plate is parallel and opposite to the base plate and providing a press section at the rear end thereof.

11. The electrical connector as defined in claim 8, wherein the front end of the insulation body forms an inserted opening for being inserted with the mating electrical connector, which has a transmission interface, and an edge at a lateral side of the inserted opening provides two opposite clamping seats and the locating element provides guide arms corresponding to the clamping seats.

12. The electrical connector as defined in claim 8, wherein the conductive terminals at the rear end of the insulation body have a supportable part respectively being fixedly connected to the cable electrically.

13. The electrical connector as defined in claim 8, further comprises a blocker to engage with the insulation body and the blocker provides partitions to separate the conductive terminals.

14. The electrical connector as defined in claim 8, further comprises a soft housing disposed at an intersection of the insulation body and the cable.

15. The electrical connector as defined in claim 14, wherein the soft housing provides a guiding opening at the vertical surface thereof.

* * * * *